United States Patent [19]

Schaiper

[11] Patent Number: 4,864,676

[45] Date of Patent: Sep. 12, 1989

[54] TOOTH BRUSH

[76] Inventor: Heinrich Schaiper, Schlosstrasse 104, D-4500 Osnabrück, Fed. Rep. of Germany

[21] Appl. No.: 159,577

[22] PCT Filed: May 30, 1987

[86] PCT No.: PCT/EP87/00280

§ 371 Date: Apr. 4, 1988

§ 102(e) Date: Apr. 4, 1988

[87] PCT Pub. No.: WO87/07484

PCT Pub. Date: Dec. 17, 1987

[30] Foreign Application Priority Data

Jun. 4, 1986 [DE] Fed. Rep. of Germany ..... 3618823

[51] Int. Cl.[4] ..... A46B 9/04

[52] U.S. Cl. ..... 15/167.1; 15/201; 15/104.94

[58] Field of Search ..... 15/167.1, 167.2, 206, 15/201, 104.94

[56] References Cited

U.S. PATENT DOCUMENTS

| | | | |
|---|---|---|---|
| 1,840,246 | 1/1932 | Newman | 15/167.1 |
| 1,930,571 | 10/1933 | Traxl | 15/206 X |
| 2,266,195 | 12/1941 | Hallock | 15/167.1 |
| 4,233,072 | 11/1980 | Watanabe . | |
| 4,472,853 | 9/1984 | Rauch | 15/201 X |
| 4,520,040 | 5/1985 | Cordts . | |

FOREIGN PATENT DOCUMENTS

| | | | |
|---|---|---|---|
| 764144 | 7/1952 | Fed. Rep. of Germany . | |
| 2548528 | 6/1931 | France | 15/167.1 |
| 1247433 | 10/1960 | France | 15/167.1 |
| 1403503 | 5/1965 | France . | |
| 1480739 | 5/1967 | France . | |
| 2172236 | 9/1973 | France . | |
| 2300140 | 9/1976 | France . | |
| 2456784 | 12/1980 | France . | |
| 197263 | 11/1983 | Japan . | |
| 52581 | 3/1985 | Japan . | |
| 03988 | 11/1983 | PCT Int'l Appl. . | |
| 01727 | 3/1984 | PCT Int'l Appl. . | |
| 516275 | 10/1938 | United Kingdom . | |
| 953651 | 3/1964 | United Kingdom . | |
| 1083791 | 9/1967 | United Kingdom . | |
| 2007129 | 5/1979 | United Kingdom . | |
| 1598814 | 9/1981 | United Kingdom . | |

OTHER PUBLICATIONS

"Thin Solid Films", Band III, No. 4, Jan. 1984, Elsevier Sequoia, Structure and Properties of Dispersion-Strengthened Cr-MgO, Cr-$Y_2O_3$, Cr-Y, and Cr-Cu Condensates, pp. 285-291.

*Primary Examiner*—Peter Feldman
*Attorney, Agent, or Firm*—Felfe & Lynch

[57] ABSTRACT

The present invention relates to a tooth brush comprising a brush handle, a brush stem, and a brush head which carries on the base face thereof a plurality of bristle tufts rising up in a generally uniform direction, wherein the brush head (3) is formed of a plurality of head sections (31, 32, 33, 34, 35, 36, 37) being resiliently movable relative to each other and each being provided with one or more bristle tufts (40, 41, 43).

8 Claims, 2 Drawing Sheets

TOOTH BRUSH

BACKGROUND OF THE INVENTION

The present invention relates to a tooth brush comprising a brush handle, a brush stem, and a brush head which carries on the base face thereof a plurality of bristle tufts rising up in a generally uniform direction.

Tooth brushes of the above kind are known conventionally and in widespread use in designs for both manual operation and electrical operation.

A drawback of all conventional tooth brushes is the insufficient cleaning efficiency in the area of the gaps between teeth. This is due to the fact that normally a rigid brush head carries a bristle array including a plurality of bristle tufts which define a substantially planar and coherent bristle surface. However, as the teeth do not define a planar surface, complete or at least sufficient cleaning of the gaps between teeth is not, or hardly, possible. The bristles of such brushes may enter the gap between teeth only with a correspondingly large deformation of the adjacent bristles. To this end, a correspondingly high pressing force must be exerted on the brush head; however, this may result in damage to the hard substance of the teeth, e. g. in wedge-shaped cleaning defects on the necks of teeth, in the course of time. Further, so high a pressing force results in the feeling of pains in the gums (gingiva), whereby a user of a tooth brush is caused to exert a lower pressing force. Finally, it is a further drawback that the bristles in a short time become deformed permanently under a high pressing force against the surface of the teeth thereby further impairing the cleaning efficiency. Actually, an adequate cleaning effect may be obtained even with the above-described tooth brushes when specific teeth cleaning techniques are adopted; in practice, however, it can be observed that such techniques are too complicated, such that these techniques are rarely practised.

Furthermore, attempts have been made to improve the cleaning efficiency by adopting special positions or attitudes of individual bristle tufts or groups of tufts, e. g. V-position or inclined position; in practice, however, any deciding improvements could not be obtained thereby, because the fundamental drawbacks of conventional tooth brushes exist as before.

SUMMARY OF THE INVENTION

Therefore, it is the object of the invention to provide a tooth brush of the kind as outlined above, which tooth brush avoids the indicated drawbacks and provides for improved surface contact to the teeth, which permits to thoroughly clean the gaps between teeth even without adopting special teeth cleaning (or brushing) techniques, which avoids damage to teeth due to excessively high pressing forces, and which provides for effective and at the same time gentle dental hygiene.

According to the invention, this object is solved by a tooth brush of the kind as outlined above, wherein the brush head is formed of a plurality of head sections being resiliently movable relative to each other and each being provided with one or more bristle tufts.

The configuration of the tooth brush according to the invention permits the brush head to conform itself to the surface of the teeth, including the gaps between teeth, such that good full-surface contact of the brush head or its bristle array, respectively, with the tooth and a good cleaning efficiency thereof is obtained, on the one hand. On the other hand, a local excessive pressing force of the bristles against the tooth is avoided, because the respective head section of the brush head is adapted to yield resiliently.

According to a preferred embodiment of the tooth brush, the brush stem is divided, at least in the region adjacent the brush head, in its longitudinal direction into a plurality of substantially parallel, resiliently deflectable part stems (or sub-stems), with each part stem having associated therewith at least one head section. Hereby, elastic deflectability of the head sections in a direction perpendicular to the surface of the tooth is realized in a simple and also effective manner, whereby the pushing and drawing forces generated primarily in the brush handle are transmitted in a linear path, so as to not affect the deflection. The degree or rate of deflection of the separate head sections is—desirably—determined by the shape of the tooth surface only. By varying the material characteristics and thickness of the part stems, the resilience of the head sections may be set to the proper value.

Particularly favorable for the cleaning of teeth which have more or less rounded surfaces, is a tooth brush in which the head sections of the brush head are arranged in concentric relation with each other in the form of at least one ring or annulus surrounding a central head section. In contrast with a planar surface, the surface contact of an annular surface with a rounded surface is greater by many times. Further, the central head section and the ring (annulus) surrounding this section are adapted to be deflected independently of each other to conform themselves to the tooth surface.

Further improved versatility or conformability is obtained in that the annular head section is divided into a pair of relatively movable half rings in the longitudinal direction of the tooth brush. By this feature, angular mispositionings of the tooth brush during the tooth cleaning process may be compensated for to a certain extent, such that a good cleaning efficiency is obtained in dental hygiene even with less careful handling of the tooth brush.

According to a further embodiment of the invention, provisions are made that the central head section has disposed therein a circular, oval or flat-elliptical rim of bristle tufts. This rim effectively contributes to the cleaning action on planar or approximately planar tooth surfaces, and also is capable of entering tooth gaps and cleaning same, because it is not retained by the surrounding bristle tufts of the other head sections, which engage the tooth surface. For a more intense cleaning of the tooth gaps, the central head section may have a central bristle tuft of a length to extend above the surrounding bristle tufts.

Also effective cleaning of the tooth gaps may be obtained by an arrangement wherein the central head section has disposed thereon a plurality of bristle tufts in such a manner that these tufts form a central bristle tuft in the tooth gap under the contact pressure of the tooth brush against the teeth; this feature may be realized by correspondingly selecting the disposition, orientation and resilience (elasticity) of the respective bristle tufts.

In order to chemically assist the dental hygiene, it is feasible that an elastic, porous, replaceable or refillable storage body of an effective substance is positioned centrally within the rim. Preferably, this storage body serves to dispense or release fluorine which, advantageously, is applied directly to the tooth surface, namely to the place where it is intended to evolve its effectiveness. This dispensing of fluorine takes place especially when the bristle tufts of the rim are moved towards each other in the region of tooth gaps, thereby applying light pressure on the storage body.

According to an alternative embodiment of the tooth brush, the head sections of the brush head are disposed in parallel with each other to extend in the longitudinal direction of the tooth brush. This configuration of the brush head also provides the above-described advantages of improved conformability to the tooth surfaces. In a further embodiment of this brush construction, it is contemplate that each part stem has associated therewith a head section curved with a U-shaped configuration in the plane of the base face, with the head section each having the free end of one of their legs of the "U" or the U-shaped curve connected to the respective part stem. Although in this embodiment the relative movability of the head sections of the brush head is slightly lower by comparison, this embodiment offers the possibility of incorporating a substantially greater number of bristle tufts.

In order to make use of the cheek pressure, applied to the rear of the brush head in every tooth cleaning operation, for obtaining a favorable distribution of the pressing force of the head sections, advantageously the head sections have, on their side opposite from the base surface, rear or back faces of respectively different heights decreasing from the center to the outer side. By this configuration, it is achieved that the head section having the highest (most projected) rear face, receives the greatest pressing force from the cheek, and that the force exerted on the other head sections is correspondingly lower.

DETAILED DESCRIPTION OF THE PREFERRED EMBODIMENT

Figure 1:
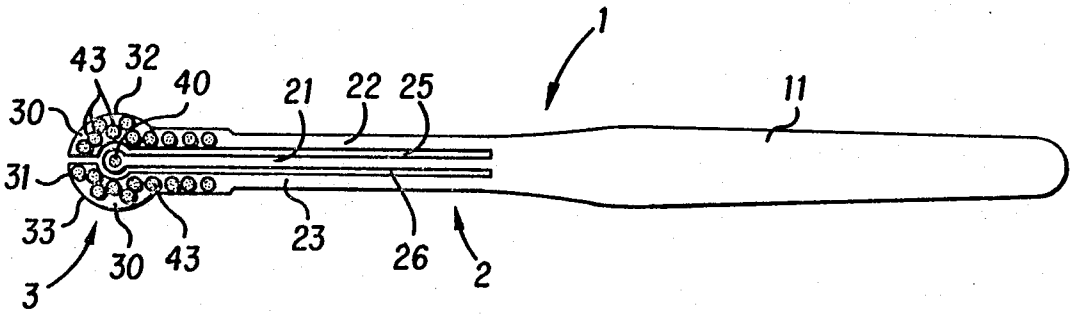
FIG. 1 is a top plan view of a tooth brush according to a first embodiment of the invention.

As appears from FIG. 1, the illustrated first embodiment of the tooth brush 1 according to the present invention comprises a brush handle 11, a brush stem 2 and a brush head 3. The handle 11 is formed in the manner as is customary for other conventional tooth brushes, whereas the stem 2 and the head 3 differ considerably from conventional brushes. In the illustrated embodiment of the brush 1, the stem 2 is divided into three part stems or sub-stems 21, 22, and 23 extending in parallel with each other, with a gap space 25 and 26, respectively, being formed between sub-stems. The thus formed sub stems 21 to 23 are, to a certain degree, resiliently pivotable relative to each other and relative to the handle 11.

Similarly, the brush head 3 does not form a rigid structure as in conventional tooth brushes, but comprises a plurality of head sections or sub-heads 31, 32, and 33. The center part stem 21 has associated therewith a central head section 31 which has a circular shape in the illustrated embodiment. A single central bristle tuft 40 is disposed on the central head section 31. Arranged concentrically around the central head section 31 are the approximately semicircularly shaped further head sections 32 and 33 which are associated with one of the sub-stems each; i. e. head section 32 is associated with the substem 22, and head section 33 is associated with sub-stem 23. Disposed on these two head sections perpendicular to the base face 30 of the brush head 3 which is seen by the viewer, are a plurality of bristle tufts 43, with some of these tufts being provided also on the head-side portions of the respective part stems 22 and 23. By this structure of the brush stem 2 in the form of part stems (or sub-stems) 21 to 23, the respective brush head sections 31 to 33 are resiliently (elastically) movable relative to each other in directions perpendicular to the longitudinal direction of the part stems, so that the brush head sections are adapted to conform themselves to the tooth surface to be cleaned in an optimum manner.

Figure 2:
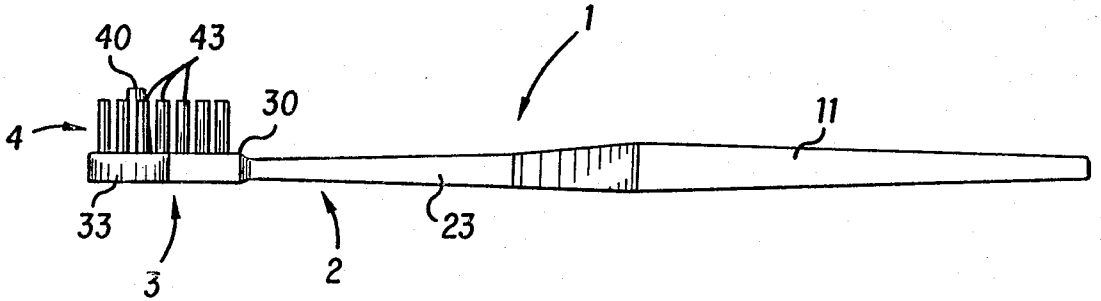
FIG. 2 is a side elevational view of the tooth brush of FIG. 1.

FIG. 2 is a side elevational view of the tooth brush 1 of FIG. 1. This Figure again shows the handle 11 and the adjoining stem 2, i. e. the part stem 23 in this instance. Joining the stem 2 is the brush head 3 which carries on its base face 30 a number of bristle tufts 43 as well as the central bristle tuft 40, which tufts form a bristle array 4 in combination with each other. It is clear from this side elevational view that the central bristle tuft 40 has a length to protrude above the surrounding bristle tufts 43. This illustrates the function division of the various head sections, which is obtained by the invention. The bristle tufts 43 serve particularly for the surface or facial cleaning of the teeth, while the protruding central bristle tuft 40 is provided for cleaning particularly the gaps between teeth.

Figure 3C:
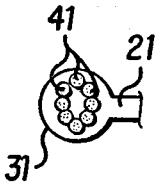
FIGS. 3*a* to 3*c* are top plan views showing different configurations of the central head section forming a part of the tooth brush according to FIGS. 1 and 2.
Figure 3B:
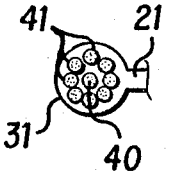
Figure 3A:
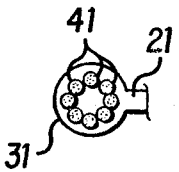

As an alternative to the configuration shown in FIGS. 1 and 2, the central head section also may be formed in the manner shown in FIGS. 3*a* to 3*c*. FIG. 3*a* illustrates the central head section 31 which is connected to the part stem 21 and which has a circular rim 41 of bristle tufts. In the embodiment according to FIG. 3*b*, an additional single central bristle tuft 40 is positioned in a central point in the rim 41 of bristle tufts. Another variant of the central head section 31, as shown in FIG. 3*c*, includes a flat elliptical configuration of the rim 41 of bristle tufts. Preferably, here the long half axes of the ellipse extend normal to the longitudinal axis of the tooth brush, whereby it is obtained that the rim 41 of bristle tufts may properly conform itself to tooth gaps under a small deformation.

Figures 4A, 4B, 5, 6:
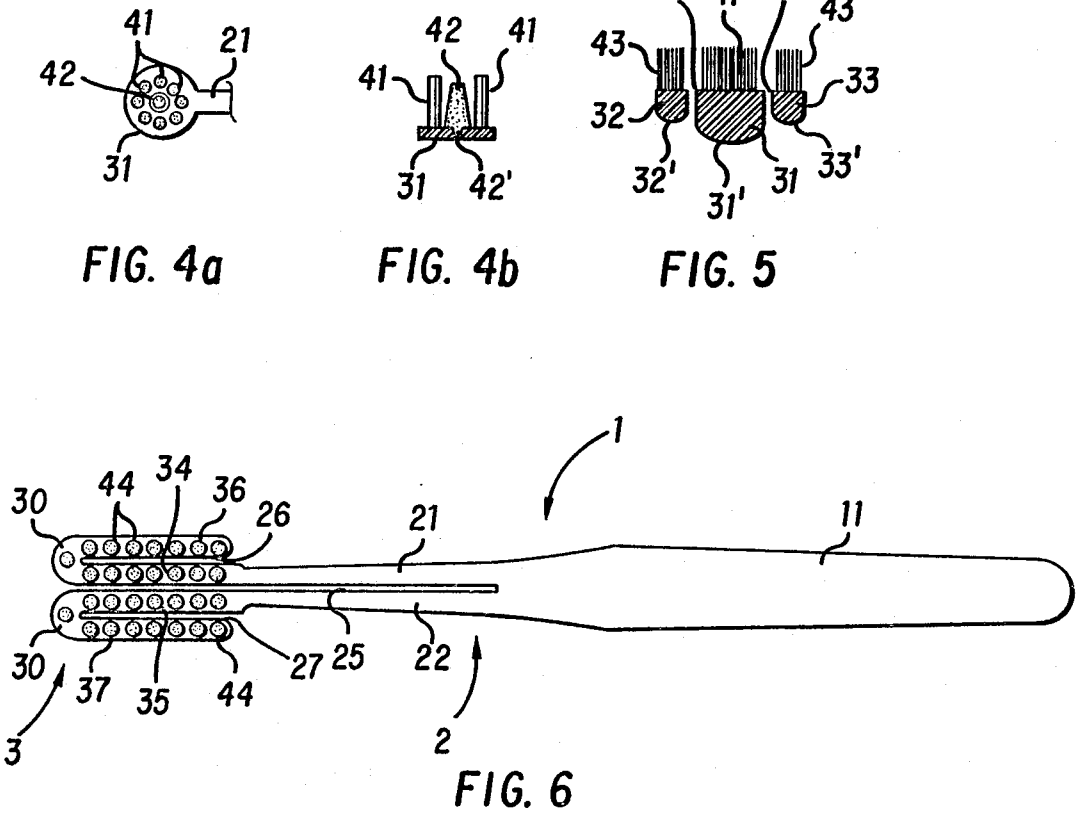
FIGS. 4*a* and 4*b* are a top plan view and a side elevational view, respectively, showing another configuration of the central head section.
FIG. 5 is a cross sectional view of a head section of a tooth brush according to the invention.
FIG. 6 is a top plan view of a tooth brush according to a second embodiment of the invention.

Another possible configuration of the central head section 31 is shown in FIG. 4*a*. In this embodiment, the central head section 31 carries a circular rim 41 of bristle tufts, and in the center thereof there is not another bristle tuft, but rather a storage body 42 for an effective substance. As appears particularly from the cross-sectional view of FIG. 4*b*, the storage body 42 shown as an example has an upwardly tapering conical shape. At its lower end, the body 42 is anchored in the central head section 31 through a projection 42'. This anchoring may be designed so as to permit easy replacement of the body 42, such that a new storage body may be installed when the effective substance, preferably fluorine, contained in the storage body has been used up. Preferably, the body 42 is formed of a porous elastic (or resilient)

material, e. g. plastic foam material, which stores the effective substance in its pores. Dispensing of the effective substance by the storage body 42 takes place, preferably, by pressing the rim 41 of bristle tufts against the outer sides of the storage body 42 in the tooth cleaning process, specifically during cleaning of tooth gaps.

A further advantageous feature according to the invention is shown in FIG. 5. This Figure illustrates a section through a brush head of a tooth brush according to the invention. Clearly shown are the portions or components of the brush head, namely the central head section 31 and the surrounding (enclosing) head sections 32 and 33, all of which are plastic in this instance. On their upper sides, these sections carry the bristle tufts 43 or the rim 41 of bristle tufts, respectively. Between the head sections 31 to 33, the gap spaces 25 and 26 can be seen which allow for friction-less movement of the head sections relative to each other.

On the side opposite from the bristles, the head sections 31 to 33 have back or rear faces 31', 32' and 33' of different heights. In the embodiment shown, the rear face 31' of the central head section 31 has a clearly higher height than the rear faces 32' and 33' of the other two head sections 32 and 33, respectively. By this configuration, during the cleaning process an increased contact pressure is exerted on the central head section 31, while the two outer head sections 32 and 33 are pressed against the tooth with a lesser force. Owing to the higher contact pressure of the central head section 31, which in fact contributes to the cleaning of specifically the tooth gaps, a particularly intense cleaning effect is produced in this region, while a lower contact pressure for cleaning the tooth surfaces or the gums, respectively, is sufficient for an adequate cleaning result.

Finally, FIG. 6 illustrates an embodiment of a tooth brush 1 according to the present invention, in which the head 3 has a distinctly varied structure. While in this tooth brush 1, too, the handle 11 is formed in the customary manner, the stem 2 thereof is divided only in two part stems 21 and 22 with an intervening gap space 25. The brush head 3 comprises four head sections 34, 35, 36, and 37 extending in parallel with each other and with the longitudinal direction of the tooth brush 1, which head sections are each provided in their base faces 30 with regularly spaced bristle tufts 44. Two head sections 34 and 36 or 35 and 37, respectively, are each associated with one part stem 21 or 22, respectively. The head sections 34 and 36 or 35 and 37 are each formed integrally with a U-shape, with the legs of the "U" each defining between them a gap space 26 or 27, respectively, and with the inner-side leg of the "U" having its free end connected to the stem 21 or 22, respectively. In this embodiment of the brush 1, too, the head sections 34 to 37 are resiliently movable relative to each other, thereby providing for good conforming of the brush head 4 to the tooth surface or the gums, respectively.

A true division of functions of the brush head is achieved for the first time by the tooth brush according to the present invention. Each head section is allocated to a specific function for which it is optimized. By this structure, thorough cleaning of the tooth gaps, fullsurface treatment of the tooth surfaces and gentle treatment of the gums are ensured in a single cleaning process.

I claim:

1. A tooth brush comprising a brush handle, a brush stem connected to said brush handle, said stem comprising a plurality of substantially parallel sub-stems which are resiliently deflectable relative to said handle, a brush head having a base face and comprising a plurality of head sections connected to said sub-stems remote from said handle, said head sections comprising a central head section and an annular head section concentrically arranged about said central head section and resiliently movable relative thereto, and a plurality of substantially parallel bristle tufts extending from said base face, said central head section carrying at least one bristle tuft, said annular head section carrying a plurality of bristle tufts.

2. A tooth brush as in claim 1 wherein said bristle tufts on said annular head section are in a substantially annular array about said central head section.

3. A tooth brush as in claim 1 wherein the annular head section is divided into a pair of relatively movable half rings, each half ring being connected to a respective sub-stem.

4. A tooth brush as in claim 1 wherein said central head section carries bristle tufts in a substantially circular array.

5. A tooth brush as in claim 1 wherein said central head section carries bristle tufts in a substantially oval array.

6. A tooth brush as in claim 1 wherein said central head section carries a central bristle tuft which protrudes above the surrounding bristle tufts.

7. A tooth brush as in claim 1 wherein said central head section carries a plurality of bristle tufts arranged so that these tufts form a central bristle tuft in a tooth gap when the tooth brush is pressed against the teeth.

8. A tooth brush as in claim 1 wherein the head sections each have a rear face opposite the base face of the brush head, said central head section having a greater depth, between said base face and its rear face, than the depth of the annular head section.

* * * * *